United States Patent [19]

Carriere

[11] 4,045,053

[45] Aug. 30, 1977

[54] CREDIT CARD TRANSFER ASSEMBLY

[76] Inventor: James L. Carriere, 4678 Lu Ann Drive, Flushing, Mich. 48433

[21] Appl. No.: 605,214

[22] Filed: Aug. 15, 1975

[51] Int. Cl.[2] ..... B41L 1/24
[52] U.S. Cl. ..... 282/22 R
[58] Field of Search ..... 282/22 R

[56] References Cited

U.S. PATENT DOCUMENTS 2,093,086 9/1937 Luzzatto ..... 282/22 R

*Primary Examiner*—Harland S. Skogouist
*Attorney, Agent, or Firm*—Basile, Weintraub & Vanophem

[57] ABSTRACT

A reversible transfer assembly for use in recording credit transactions is disclosed herein. The assembly hereof is particularly useful in conjunction with credit card "zip-zap" machines as well as hand written transactions.

6 Claims, 3 Drawing Figures

CREDIT CARD TRANSFER ASSEMBLY

BACKGROUND OF THE INVENTION

1. Field of the Invention

The present invention pertains to transfer assemblies. More particularly, the present invention pertains to transfer or impression assemblies for use with credit card or hand written transactions. Even more particularly, the present invention pertains to manual or credit card transfer or impression systems or assemblies which are reversible.

2. Prior Art

The use of credit cards for purchasing goods, returning goods, for banking deposits and withdrawals is an ever increasing occurrence. This is due not only to the convenience attendant the use of same, but also because of the control which can be established over accounts, as well as, the actual transaction which is occurring.

In recording a credit card transaction, one of the more common systems employed is of the type wherein the credit card is placed upon a machine, a transfer or impression slip or slips is then placed over the credit card, and then, a roller or handle is passed over this array. Because of the construction of the transaction slip or slips, an impression is provided thereon. It is to be noted in this regard that the machine is hereinafter referred to as a zip-zap machine.

Conventionally, only one transaction, i.e. a purchase or a return, a deposit or a withdrawal, is achieved through present day systems. However, it is quite often the occasion wherein a purchaser purchases and returns goods simultaneously, or makes both a banking deposit and a banking withdrawal simultaneously. Under present day circumstances it is necessary to use different encoded transfer assemblies to achieve both transactions. In other words, two transactions requiring two separate operations must be carried out in order to return goods and purchase goods or transact a banking deposit or a banking withdrawal, at any one time. This is a time consuming process as well as one requiring an undue amount of paper. Thus, a major advancement in the art would be provided if it would be possible to record a purchase and a return and/or a banking deposit and withdrawal on a single credit card transfer assembly. It is to this to which the present invention is directed.

SUMMARY OF THE INVENTION

In accordance with the present invention, there is provided a reversible credit transfer or impression assembly. The assembly hereof is particularly adapted for use with a zip-zap machine and credit card therefor or for hand written transactions.

The assembly hereof comprises a plurality of impression receiving sheets having interposed therebetween sheets having a transfer medium disposed thereon. The transfer medium is disposed on the sheets carrying same in a manner such that the form can be reversed or rotated 180° about a horizontal axis and still be rendered useful.

In a preferred form of the assembly, each of the sheets have one end thereof secured together, such as by gluing or the like. Proximate the secured ends, each of the sheets are perforated to permit the separation thereof from the assembly.

For a more complete understanding of the present invention, reference is made to the following detailed description and accompanying drawing. In the drawing, like reference characters refer to like parts throughout the several views in which:

DESCRIPTION OF THE PREFERRED EMBODIMENTS

Figure 1:
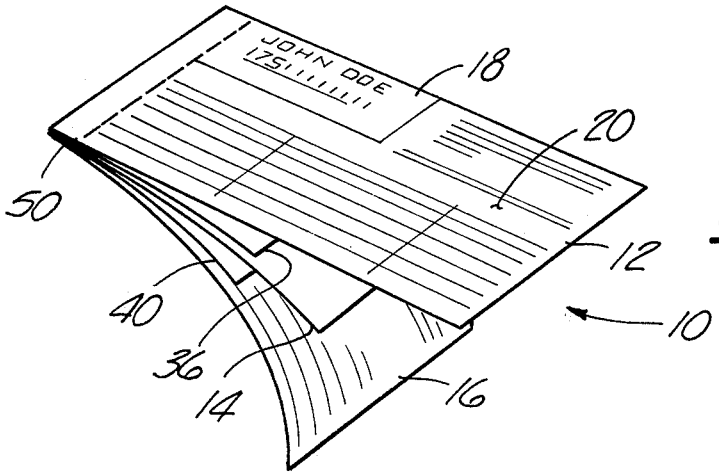
FIG. 1 is a perspective view of a transfer assembly in accordance herewith.
Figure 2:
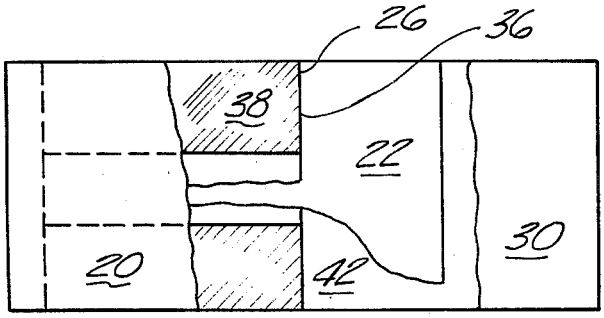
FIG. 2 is a broken, top plan view of the assembly hereof.
Figure 3:
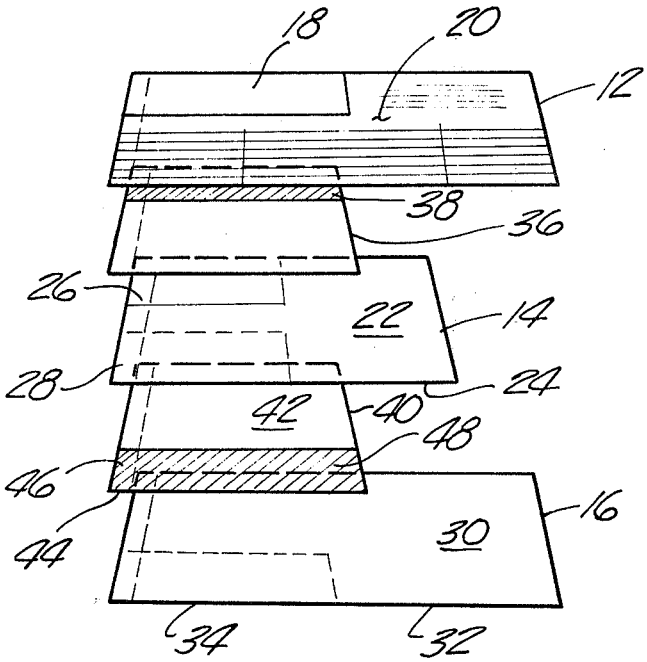
FIG. 3 is an exploded perspective view of the assembly hereof.

As hereinbefore noted, the credit transfer or impression assembly hereof is particularly adapted for use with a zip-zap machine and credit card therefor. The zip-zap machines are known to the skilled artisan as well as the credit cards. Furthermore, it is to be understood that the machine, per se, does not form any part of the instant invention. However, the present invention is particularly adapted for use therewith.

Now, and with reference to the drawing, there is depicted therein a credit card transfer or impression assembly, generally indicated at 10. The assembly 10 comprises a plurality of sheets 12, 14, 16 which are transfer medium receiving sheets. As is known to those skilled in the art to which the invention pertains, when the handle of the machine is passed over the credit card and assembly, an impression of the credit card holder's name and account number are conventionally transferred onto these transfer or impression receiving sheets.

With more particularity, and for purposes of clearly understanding the instant invention, the sheet 12 will hereinafter be referred to as the upper sheet; the sheet 14 will hereinafter be referred to as the receipt sheet and the sheet 16 will hereinafter be referred to as the bottom sheet.

The sheet 12 has a predetermined area 18 provided on the upper surface 20 which, during use, receives the users name and account in the known manner.

The receipt sheet has an upper surface 22 and a lower surface 24. The upper surface has a predetermined area 26 which is coincident with the predetermined area 18 of the sheet 12 and which also receives the user's name and account. The under surface 24 of the receipt sheet has a predetermined area 28 which also functions to receive the user's name and account when disposed in a zip-zap machine in the manner to be detailed subsequently.

The bottom sheet 16 has an upper surface 30 which is blank and a lower surface 32 which has a predetermined area 34 which is adapted to be coincident with the predetermined area 28 of the receipt sheet.

Interposed between the sheets 12, 14 is a first transfer medium carrying sheet 36. The sheet 36 has a pattern carbon or other transfer medium 38 deposited thereon in a predetermined position and on at least one surface thereof. The predetermined area is coincident with the predetermined areas 18 and 26 provided on the upper surfaces 20 and 22, respectively, of sheets 12 and 14.

As is known to those skilled in the art, the pressure exerted by the handle as it passes over the credit card and transfer assembly, causes an impression to be transferred to both the upper sheet 12 and the receipt sheet 14. In a preferred embodiment of the invention, the medium 38 disposed on the sheet 36 is provided on the under surface thereof such that it is directly coincident with the space or predetermined area 26 provided on the upper surface 22 of the sheet 14. However, this does not preclude the depositing or replacement of the medium on a predetermined area on both sides of the sheet 36 in the heretofore referred to predetermined areas.

Interposed between the receipt sheet 14 and the bottom sheet 16 is a second transfer medium carrying sheet 40. The sheet has an upper surface 42 and a lower surface 44.

Deposited on the lower surface 44 is a predetermined area 46 is a carbon or other transfer medium 48. The predetermined area 46 is dimensioned such that it is coincident with the predetermined area 28 provided on the undersurface 24 of the receipt sheet 14 and the predetermined area 34 provided on the undersurface 32 of the bottom sheet 16. Although the medium surface 48 is taught as being on only one side of the sheet 40, it could be likewise deposited on both sides thereof over the predetermined areas.

Furthermore, it should be noted with respect hereto that it is preferable, in the practice of the present invention, that the transfer medium be carbon. Although other well-known transfer mediums can be used herein, carbon type transfer media are preferred in zip-zap machines.

Referring again to the drawing, it is to be noted that each of the sheets 12, 14, 16, 36 and 40 have one end thereof secured to one another such as gluing or the like to bind the sheets together. Laterally spaced from the glued end is a perforation 50 which extends through all of the sheets such that any one sheet can be separated from the assembly without disturbing the other elements thereof.

It is to be appreciated from the construction hereof that the instant assembly is reversible in the following manner.

Assuming that the orientation of the assembly is such that the upper sheet is disposed face up in a zip-zap machine, then, by passing the handle thereover, with the credit card disposed beneath same, then a recorded transaction will be transferred to both the receipt sheet 14 and the cover sheet 12, with the carbon transferring the user's account number and name to the predetermined areas 18 and 26 provided on the cover sheet 12 and the receipt sheet 14, respectively. By providing suitable indicia on the upper surfaces 20 and 22 this transaction could be rendered a purchase, return, banking deposit or banking withdrawal.

If the assembly 10 is then turned over, i.e. rotated 180° about the horizontal axis, such that the under surface 32 of the sheet 16 faces upwardly, then, by virtue of the disposition of the transfer medium on the sheet 40, when the handle of the machine is passed over the assembly, the user's name and account will be transferred and imprinted in the predetermined areas 34 and 28 of the bottom sheet 16 and the receipt sheet 14, respectively.

It is to be appreciated from the foregoing that no matter what the transaction, there is always an impression transferred to the middle or receipt sheet 14. Furthermore, in the event that simultaneous transactions are recorded, they will both be impressed upon the sheet 14 on both the supper surface 22 and the lower surface 24 thereof.

Although the present invention has been described with reference to the use of a credit card, it is to be understood that the present assembly is equally useful in recording hand written transactions. The pressure applied by the writting instrument will cause the transfer medium to transfer the transaction to the receipt sheet.

Furthermore, it is contemplated herein that in order to facilitate sorting of the assemblies at the transacting institution, that means be provided to accommodate quick sorting. Thus, the upper surface 20 of sheet 18 and the upper surface 22 of receipt sheet 14 are provided with a first corresponding indicating means, e.g. a first color. The bottom surface 32 of the bottom sheet 16 and the undersurface 24 of the receipt sheet 16 are provided with corresponding second indicating means, different from the first indicating means, e.g. a second color. In this manner the type of transaction or transactions recorded on the assembly are immediately identifiable.

It is to be further appreciated that by the practice of the present invention, it is possible to record two transactions in a single operation. Thus, a purchase can be recorded by having the assembly in a first orientation and a return of goods can also be recorded by placing the assembly in a second or opposite orientation wherein the assembly 10 is rotated about the horizontal axis 180°.

Having thus described the invention, what is claimed is:

1. A credit card transfer assembly, comprising:

a. a first transfer medium receiving sheet having an upper surface and a lower surface, the upper surface having a predetermined area for receiving a credit card impression, b. a second transfer medium receiving sheet having an upper surface and a lower surface, the upper surface having a predetermined area for receiving a credit impression, the predetermined area being coincident with the predetermined area of the first medium receiving sheet, the lower surface having a predetermined area for receiving a credit card impression which is spaced from the upper surface predetermined area to prevent coincidence therebetween, c. a third transfer medium receiving sheet having an upper surface and a lower surface, the lower surface having a predetermined area for receiving a credit card impression, the predetermined area being coincident with the predetermined area of the lower surface of the second transfer medium receiving sheet, d. a first transfer medium carrying sheet interposed between the first and second transfer medium receiving sheets, e. a second transfer medium carrying sheet interposed between the second and third transfer medium sheets, and wherein the upper surface of the first transfer medium receiving sheet, carrying sheet and the upper surface of the third transfer medium receiving sheet cooperate to record a first transaction and the third transfer medium receiving sheet, the second transfer medium carrying sheet and the lower surface of the second transfer medium receiving sheet cooperate to record a second transaction upon a 180° rotation of the assembly about a horizontal axis, and further wherein the first transaction is recorded solely upon the upper surface of the first and second transfer medium receiving sheets and the second transaction is recorded solely upon the lower surfaces of the second and third transfer medium receiving sheets.

2. The assembly of claim 1 wherein:

a. the upper surface of the first transfer medium receiving sheet and the upper surface of the second transfer medium receiving sheet are colored with a first color, and b. the lower surface of the second transfer medium receiving sheet and the lower surface of the third transfer medium receiving sheet are colored with a second color which is different from the first color.

3. The assembly of claim 1 wherein the transfer medium is carbon.

4. The assembly of claim 1 wherein:

the sheets are detachably bound together along a common edge thereof.

5. The assembly of claim 1 wherein the transfer media are disposed on their respective sheets in predetermined areas coincident with the respective first and second sheet areas and second and third sheet areas.

6. The assembly of claim 5 wherein the transfer medium of the first transfer medium sheet is in contact with the second transfer medium receiving sheet and the transfer medium of the second transfer medium carrying sheet is in contact with the second transfer medium receiving sheet.

* * * * *